US008659372B2

(12) United States Patent
Morimura

(10) Patent No.: US 8,659,372 B2
(45) Date of Patent: Feb. 25, 2014

(54) ELECTROMAGNETIC RELAY

(75) Inventor: Masato Morimura, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 13/565,219

(22) Filed: Aug. 2, 2012

(65) Prior Publication Data

US 2013/0033344 A1 Feb. 7, 2013

(30) Foreign Application Priority Data

Aug. 3, 2011 (JP) ..... 2011-170367

(51) Int. Cl.
*H01H 51/22* (2006.01)
*H01H 9/30* (2006.01)

(52) U.S. Cl.
USPC ..... 335/78; 335/201

(58) Field of Classification Search
USPC ..... 335/179, 201
See application file for complete search history.

(56) References Cited

U.S. PATENT DOCUMENTS

| | | | | |
|---|---|---|---|---|
| 2,875,304 | A * | 2/1959 | White | 218/26 |
| 3,177,305 | A * | 4/1965 | Lehman | 200/6 B |
| 5,004,874 | A * | 4/1991 | Theisen et al. | 218/151 |
| 6,700,466 | B1 * | 3/2004 | Yamamoto et al. | 335/132 |
| 7,259,646 | B2 * | 8/2007 | Rab et al. | 335/201 |
| 7,915,985 | B2 * | 3/2011 | Schmitz et al. | 335/201 |
| 8,008,999 | B2 * | 8/2011 | Morimura | 335/78 |
| 2005/0219019 | A1 * | 10/2005 | Braun et al. | 335/126 |
| 2008/0030289 | A1 * | 2/2008 | Kralik | 335/201 |
| 2010/0039195 | A1 * | 2/2010 | Morimura | 335/189 |
| 2011/0181381 | A1 * | 7/2011 | Sasaki et al. | 335/78 |
| 2012/0092096 | A1 * | 4/2012 | Choi | 335/185 |

FOREIGN PATENT DOCUMENTS

| | | |
|---|---|---|
| JP | 2000-195402 | 7/2000 |
| JP | 2010-44973 | 2/2010 |

* cited by examiner

*Primary Examiner* — Alexander Talpalatski
(74) *Attorney, Agent, or Firm* — Staas & Halsey LLP

(57) ABSTRACT

An electromagnetic relay includes an electromagnet that generates a magnetic field when electric current is supplied thereto, an actuator that is actuated in response to the generated magnetic field, a contact that opens and closes in response to the actuation of the actuator, the contact including a first contact and a second contact that contacts with the first contact when the contact closes, and a housing including a first housing that includes walls defining a recess that accommodates the electromagnet, the actuator and the contact therein, and a second housing that is fixed to the first housing and covers the recess of the first housing. The electromagnetic relay also includes a permanent magnet provided on an outer surface of the housing at a position corresponding to a position of the contact.

12 Claims, 12 Drawing Sheets

ELECTROMAGNETIC RELAY

CROSS-REFERENCE TO RELATED APPLICATIONS

This application is based upon and claims the benefit of priority of the prior Japanese Application No. 2011-170367, filed Aug. 3, 2011, the entire contents of which are incorporated herein by reference.

BACKGROUND OF THE INVENTION

1. Field of the Invention

This invention relates to an electromagnetic relay. The invention also relates to a method for producing such an electromagnetic relay.

2. Description of the Related Art

An electromagnetic relay is required to provide for passage and blockage of a large current of high-voltage direct current, when it is used for an industrial power supply equipment, such as an uninterruptible power supply (UPS) installed in a telecommunication base station, or for a power conditioner or a rechargeable battery in a fuel cell system or a solar power system. In an electromagnetic relay in these applications, it is necessary to provide a sufficient movable range of movable contacts so as to switch the power source on and off, and it tends to complicate the configuration or increase the size in order to improve heat dissipation capacity and durability. JP 2010-44973 A describes an electromagnetic relay with an actuating part having an improved form in order to address such issues.

It has been known in an electromagnetic relay that arc discharge occurs when a movable contact moves apart from a fixed contact or when the movable contact approaches to the fixed contact. This phenomenon becomes more remarkable, as a voltage applied to the electromagnetic relay becomes higher or an electric current passing through the electromagnetic relay becomes larger. The arc discharge could result in damaging the contacts or decreasing blockage capability of the electric current.

An electromagnetic relay has been known, including a bar-shaped magnet having a length equal to or greater than the distance between a pair of fixed contacts (or a pair of movable contacts), the magnet being provided opposite to a gap between the fixed contacts and the movable contacts. (See JP 2000-195402 A, for example.). The electromagnetic relay is designed to generate a magnetic field perpendicular to the gap between the fixed contacts and the movable contacts by providing the magnet inside the side wall of a cover enclosing the respective parts, thereby cutting off the arc discharge. In this configuration, the magnet is placed on a side wall of the cover by insert molding, or in a pocket which has been formed in the cover prior to placement of the magnet.

There is a need for an inexpensive electromagnetic relay having a simpler configuration, which allows for passage and blockage of a high voltage and/or a large current.

SUMMARY OF THE INVENTION

According to one embodiment of the present invention, an electromagnetic relay is provided, the electromagnetic relay comprising:

- an electromagnet that generates a magnetic field when electric current is supplied thereto;
- an actuator that is actuated in response to the generated magnetic field;

- a contact that opens and closes in response to the actuation of the actuator, the contact including a first contact and a second contact that contacts with the first contact when the contact closes;
- a housing including:
  - a first housing that includes walls defining a recess that accommodates the electromagnet, the actuator aria the contact therein; and
  - a second housing that is fixed to the first housing and covers the recess of the first housing; and
  - a permanent magnet provided on an outer surface of the housing at a position corresponding to a position of the contact.

DETAILED DESCRIPTION

Figure 1:
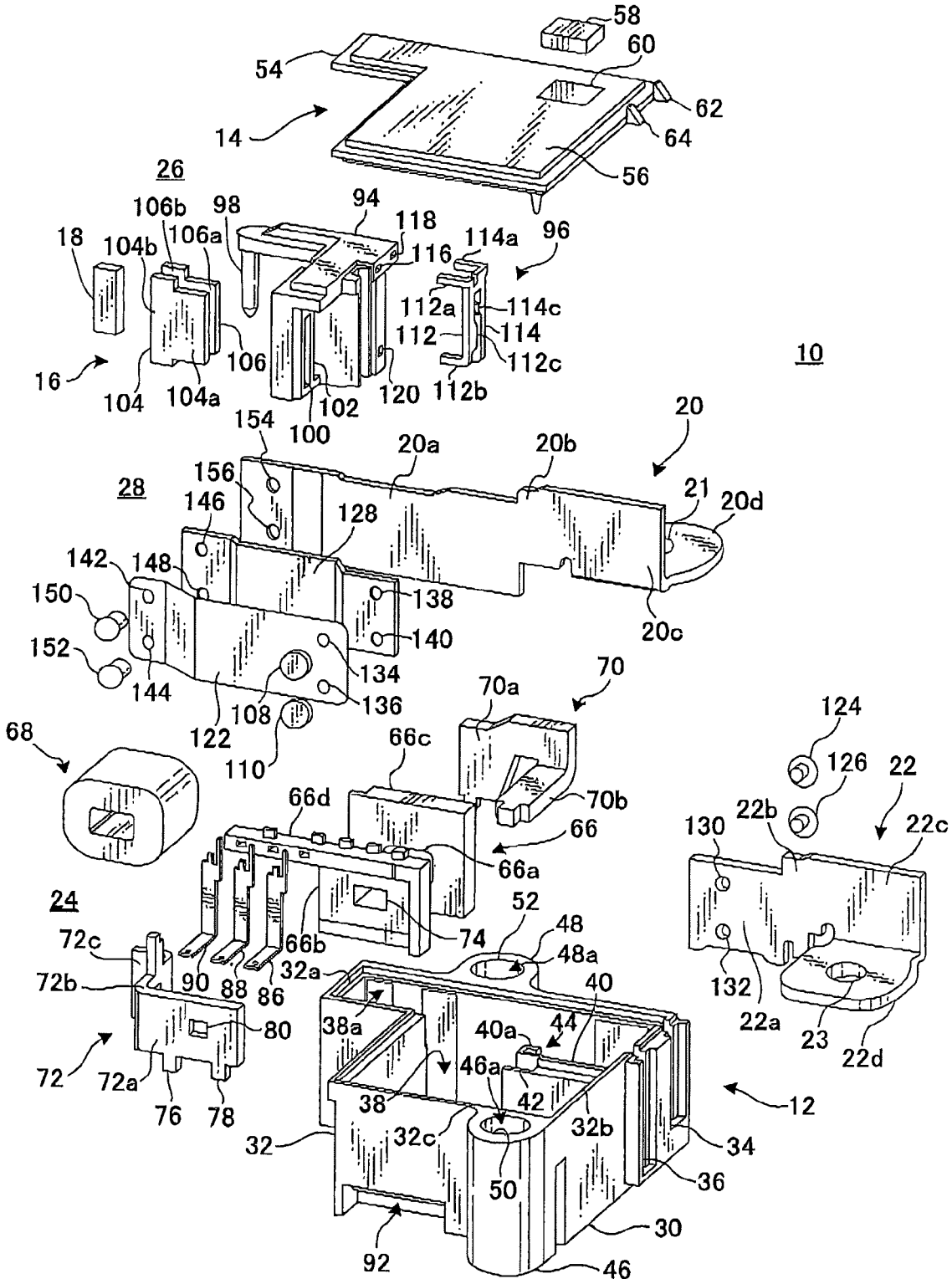
FIG. 1 is an exploded perspective view illustrating an electromagnetic relay according to a first embodiment of the present invention.

In the following, embodiments of the present invention will be described with reference to the accompanied drawings. Like elements commonly used in different drawings or different embodiments are designated with the same reference numerals. The scale of elements relative to one another may be modified for the purpose of clarifying the drawings. Although particular relationships between the positions of elements or particular orientations of elements may be specified in the following description, these particularities are not intended to limit practical applications or manners in which each element is provided in relation to one another, but to merely explain particular embodiments as illustrated in the drawings, unless mentioned otherwise.

Figure 2:
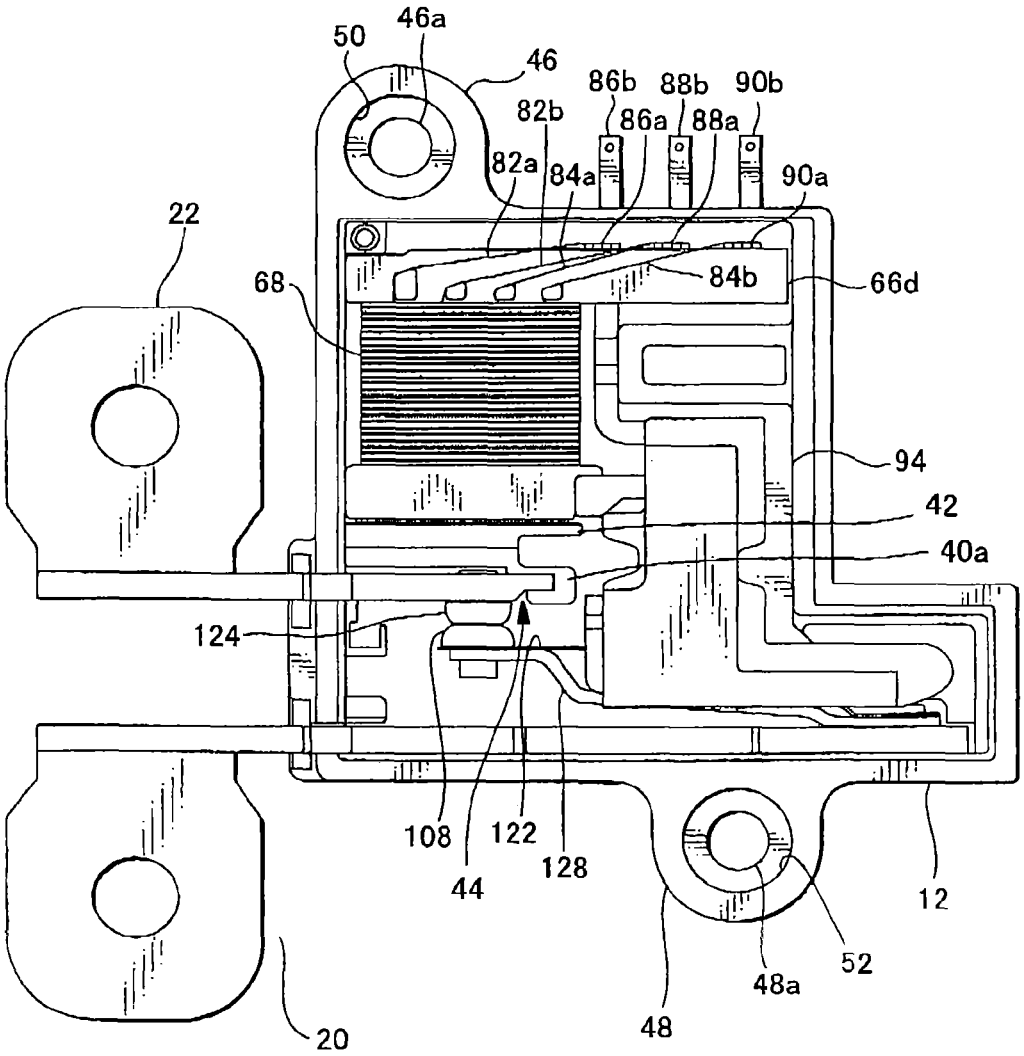
FIG. 2 is a plan view illustrating the electromagnetic relay according to the first embodiment of the present invention in a state where a cover is removed.
Figure 3:
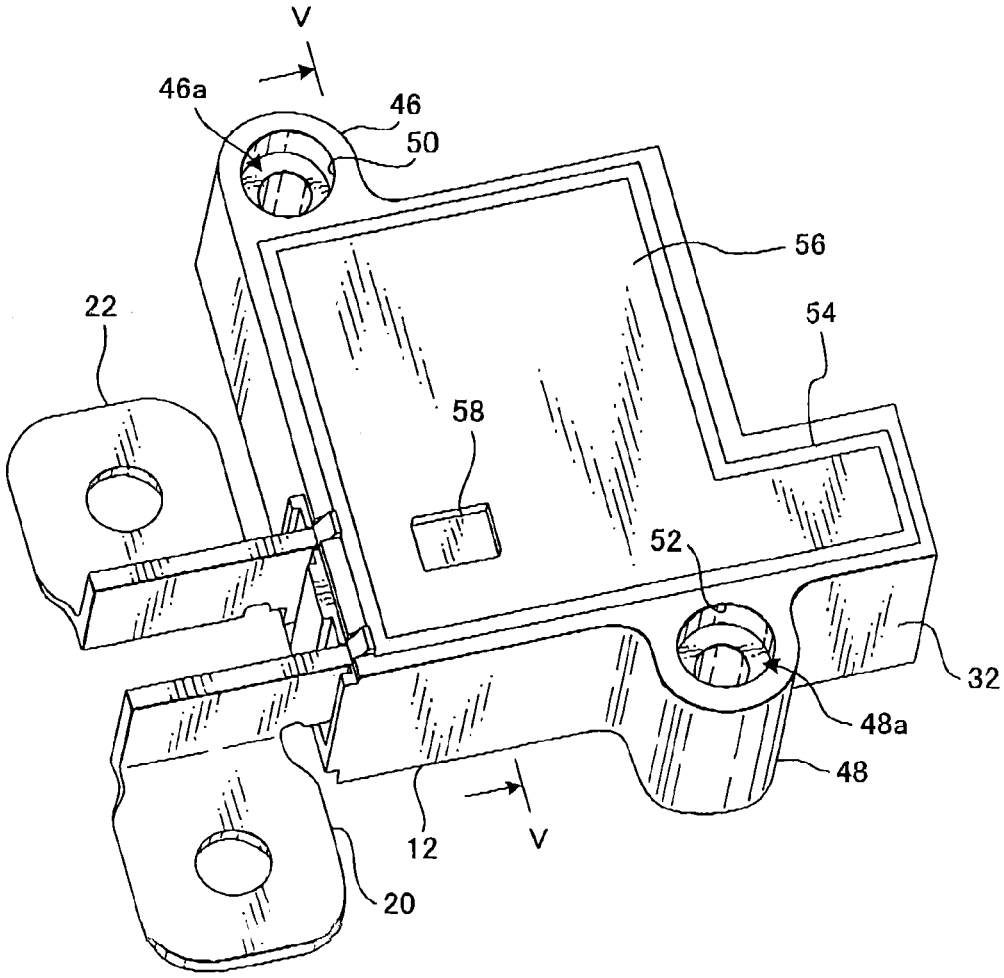
FIG. 3 is a perspective view illustrating the electromagnetic relay according to the first embodiment of the present invention, viewed from the cover.
Figure 4:
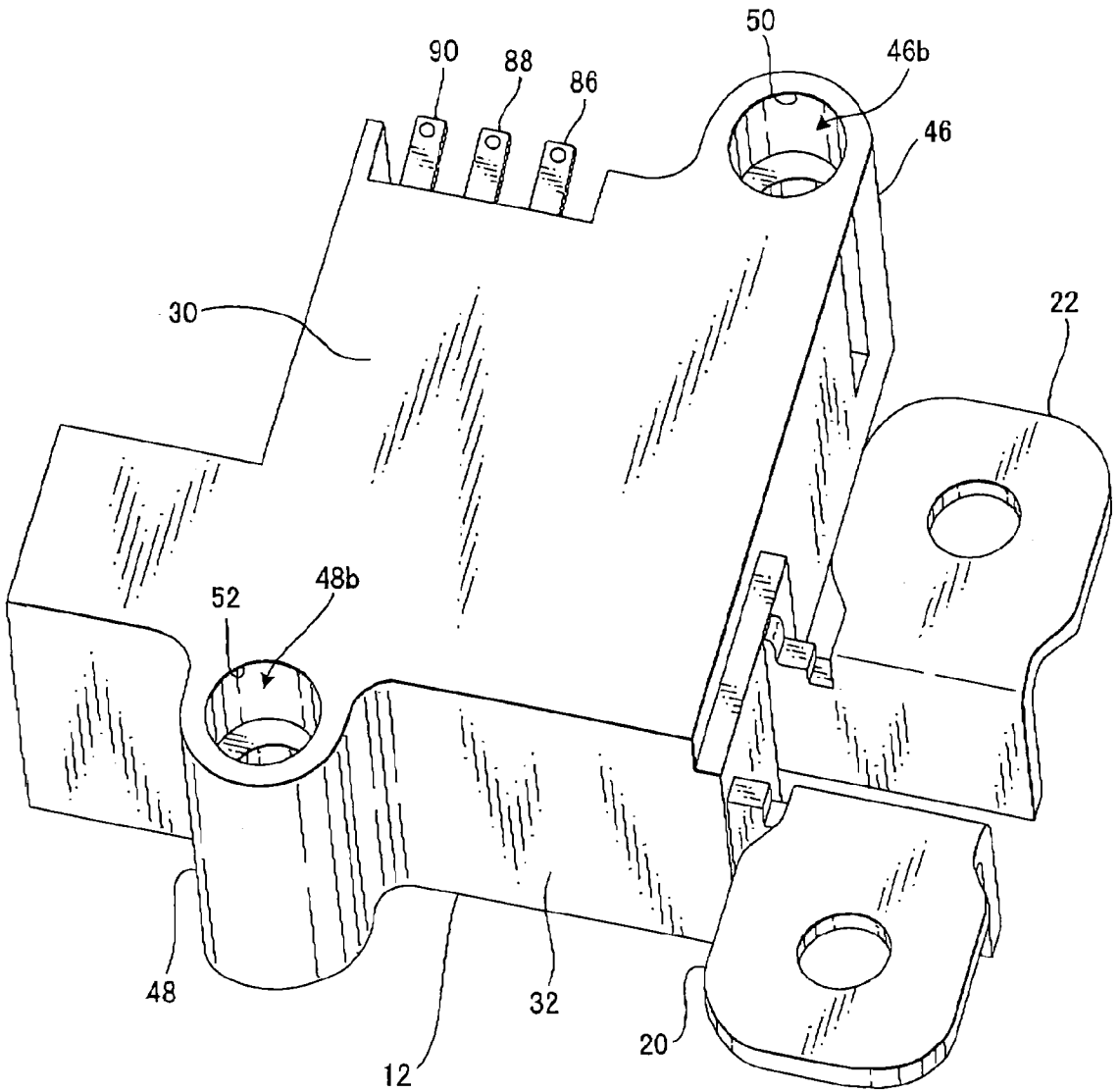
FIG. 4 is a perspective view illustrating the electromagnetic relay according to the first embodiment of the present invention, viewed from a base.
Figure 5:
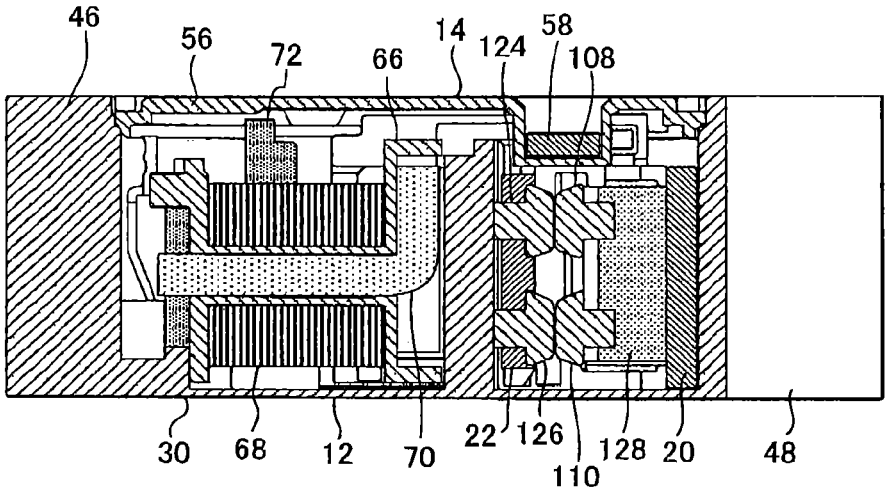
FIG. 5 is a sectional view illustrating the electromagnetic relay according to the first embodiment of the present invention, taken along line V-V in FIG. 3.

First, an electromagnetic relay 10 according to a first embodiment of the present invention will be described below with reference to FIGS. 1 to 5, which schematically illustrate the electromagnetic relay 10. FIG. 1 is an exploded perspective view illustrating main parts of the electromagnetic relay 10, FIG. 2 is a plan view illustrating the arrangement of each component mounted to a base 12, FIG. 3 is a perspective view illustrating the electromagnetic relay 10, viewed from a cover 14, FIG. 4 is a perspective view illustrating the electromagnetic relay 10, viewed from the base 12, and FIG. 5 is a sectional view illustrating the electromagnetic relay 10, taken along line V-V in FIG. 3.

The electromagnetic relay 10 is a polarized electromagnetic relay which includes a permanent magnet 18 incorporated to an armature 16 and functions to switch between states of passing and blocking an electric current flowing through a pair of bus bar terminals 20 and 22. The electromagnetic relay 10 includes an electromagnet part 24 which generates a magnetic field in response to electric power supplied from an external source, an actuating part 26 which is actuated in response to the generated magnetic field, and a contact part 28 which opens or closes a pathway of an electric current in response to the movement of the actuating part 26. Each component of the electromagnet part 24, the actuating part 26 and the contact part 28 is accommodated in the interior of a housing formed by a base (first housing) 12 made of resin and a cover (second housing) 14 made of resin.

The base 12 is an example of a first housing for holding the electromagnet part 24, the actuating part 26 and the contact part 28. The base 12 has a plate-like end wall 30 having a substantially L-shaped contour in plan view, and a peripheral wall 32 provided along the outer edges of the end wall 30, so as to project from the end wall 30 to a certain height in one direction. The peripheral wall 32 defines an opening opposite to the end wall 30. The peripheral wall 32 has at its one edge grooves 34 and 36 in a height direction of the peripheral wall 32. The peripheral wall 32 and the end wall 30 define a recess 38 having a substantially L-shaped cross section for accommodating components necessary for an operation of the electromagnetic relay 10 (in particular, the electromagnet part 24, the actuating part 26 and the contact part 28). The recess 38 has a rectangular portion and an extended portion 38*a* laterally extending from a part of one edge of the rectangular portion. The base 12 has wall portions 40 and 42 which extend from a portion 32*b* of the peripheral wall 32 to substantially the middle of the recess 38. The wall portion 40 has on a side opposite to the peripheral wall 32 a tip 40*a* which has a U-shaped cross section and defines a groove 44 for receiving the bus bar terminal 22.

The base 12 has a pair of attachment portions 46 and 48 on outer side faces of the peripheral wall 32. The attachment portions 46 and 48 have a cylindrical shape, respectively, and have through-holes 50 and 52 in parallel to the height direction of the peripheral wall 32. Also referring to FIGS. 3 and 4, the through-hole 50 has a pair of receiving portions 46*a* and 46*b*, one of which is provided opposite to the other. Similarly, the through-hole 52 has a pair of receiving portions 48*a* and 48*b*, one of which is provided opposite to the other. The receiving portions 46*a*, 46*b*, 48*a* and 48*b* all have the same shape configured so as to receive and support a part of a known fixing means such as a bolt (for example, a head of a bolt) for fixing the electromagnetic relay 10. By means of the fixing means inserted to the through-holes 50 and 52, the electromagnetic relay 10 can be fixed to a substrate or any other suitable support body. With the configuration in which the suitable fixing means can be received in both directions from the ends of the through-hole 50 of the attachment portion 46 and the through-hole 52 of the attachment portion 48, the electromagnetic relay 10 can be mounted to the support body, irrespective of which sides of the base 12 and the cover 14 face the support body.

The cover 14 is an example of a second housing attached to the base 12 via a joining portion 54. The cover 14 is formed from a plate-like member having a substantially L-shaped contour in plan view, corresponding to the shape of the recess 38. The cover 14 has in its outer periphery the joining portion 54 which engages with an engageable portion 32*a* extending along inner side faces of the opening end of the peripheral wall 32 of the base 12. The cover 14 has a second end wall 56 which is provided opposite to and in parallel to the end wall 30 of the base 12, so as to close the recess 38 when the joining portion 54 engages with the engageable portion 32*a* of the peripheral wall 32 of the base 12. As described below in further details, on the outer surface of the second end wall 56 opposite to the recess 38, there is an accommodating portion 60 capable of accommodating a permanent magnet 58 opposite to the contact part 28 with the second end wall 56 interposed therebetween. The cover 14 has protrusions 62 and 64 at its one edge. These protrusions 62 and 64 have a supplementary shape so as to cooperate with the grooves 34 and 36 formed on the edge of the peripheral wall 32 of the base 12, and to surround engageable portions 20*b* and 22*b* of the bus bar terminals 20 and 22 (described below), when the housing is formed by engaging the joining portion 54 of the cover 14 to the engageable portion 32*a* of the base 12.

The electromagnet part 24 is provided in a space defined by the wall portion 42 of the base 12, the part 32*b* of the peripheral wall 32 extending perpendicular to the wall portion 42, and the part 32*c* of the peripheral wall 32 extending in parallel to and spaced apart from the wall portion 42. The electromagnet part 24 includes a bobbin 66 made of resin, a coil 68 formed by winding an electric wire, a core member 70 and a yoke 72.

The bobbin 66 includes a tubular portion 66*a* and flanges 66*b* and 66*c* provided at the ends of the tubular portion 66*a*. The coil 68 is formed by winding the electric wire around the tubular portion 66*a*. A through-hole 74 continuously extends through the tubular portion 66*a* and the flanges 66*b* and 66*c*. A core 70*b* extending from an end plate portion 70*a* of the core member 70 substantially at right angle is adapted to be inserted to the through-hole 74. In order to clarify the drawings, the electric wire of the coil 68 is either not shown or only schematically illustrated in the drawings.

The yoke 72 has an end plate portion 72*a* provided along the flange 66*b*, an intermediate plate portion 72*b* bent from the end plate portion 72*a* and extending along one side of the coil 68 beyond the middle point of the coil 68 in an axial direction, and a tip plate portion 72*c* bent again from the intermediate plate portion 72*b* and extending in parallel to the end plate portion 72*a* in a direction opposite to the end plate portion 72*a*. The end plate portion 72*a* has protrusions 76 and 78, which are pressed into recesses (not shown) situated certain positions in the base 12. The end plate portion 72*a* further has an engaging hole 80 with which a tip portion of the core 70*b* is engaged. The tip plate portion 72*c* is positioned so as to be spaced apart from, opposite to and substantially in parallel to a part of the end plate portion 70*a* of the core member 70, when the electromagnet part 24 is assembled. When the coil 68 is excited, a magnetic field is generated between the tip plate portion 72*c* of the yoke 72 and the end plate portion 70*a* of the core member 70.

The electric wire of the coil 68 is at its tip end connected to coil terminals 86, 88 and 90. In the illustrated configuration, the coil is formed by a first electric wire whose ends 82*a* and 82*b* are connected to the coil terminals 86 and 88, respectively, and a second electric wire whose ends 84*a* and 84*b* are connected to the coil terminals 88 and 90, respectively (FIG. 2). The coil terminals 86, 88 and 90 have plate-like main portions 86*a*, 88*a* and 90*a* electrically connected to the electromagnet part 24 by winding the electric wire at the upper ends, tip portions 86*b*, 88*b* and 90*b* bent at the lower ends of the main portions 86*a*, 88*a* and 90*a* substantially at right angle and extending horizontally. The upper ends of the coil terminals 86, 88 and 90 are attached to the extended portion 66*d* extending from the flange 66*b* to the right in FIG. 2 by pressing, adhering or in any other known manner. The tip portions 86*b*, 88*b* and 90*b* of the coil terminals 86, 88 and 90 project outside the base 12 through a cutaway portion 92 formed in the end wall 30 and the peripheral wall 32 at one corner of the base 12, when the electromagnet part 24 is mounted to the base 12. The tip portions 86*b*, 88*b* and 90*b* of the coil terminals 86, 88 and 90 are in the form of a tab terminal having a flat plate shape and can be connected to a female type connection part or a clamp part for receiving the tab terminal. Alternatively, the tab terminal may be coupled to the connection part by means of other known technique such as soldering. With the configuration in which the coil terminals 86, 88 and 90 are the tab terminals, the electromagnet part 24 can be easily connected to various means (not shown) for supplying an electric current for excitation. However, the coil terminals 86, 88 and 90 may also be known type of terminals other than the tab terminal. The number of the coil terminals is not limited to the above, and may also be two or four or more, depending upon the coil configuration.

The actuating part 26 of the electromagnetic relay 10 includes an armature 16 which is actuated in response to magnetic force generated by the electromagnet part 24, an actuating body 94 for holding the armature 16, and a card 96 for transmitting movement of the actuating part 26 to the contact part 28. The actuating body 94 has a substantially L-shaped contour in plan view. The L-shaped actuating body 94 has a shaft 98 at one end, and elongated grooves 100 and 102 extending in parallel to each other in the vertical direction at the other end. The shaft 98 is rotatably inserted into a recess (not shown) provided at the bottom of the extended portion 38*a* of the recess 38 of the base 12.

The armature 16 includes two plate members 104 and 106 made of a magnetic material such as iron, and a permanent magnet 18 held between these plate members 104 and 106. The plate members 104 and 106 are attached to the actuating body 94 by inserting narrower portions 104*a* and 106*a* (right side in FIG. 1) of the plate members 104 and 106 into the grooves 100 and 102 of the actuating body 94 and bringing wider portions 104*b* and 106*b* (left side in FIG. 1) of the plate members 104 and 106 into engagement with the actuating body 94. Since the permanent magnet 18 is provided between the wider portions 104*b* and 106*b* of the plate members 104 and 106, each of the plate members 104 and 106 is connected to one of the poles of the permanent magnet 18, respectively. Thus, a magnetic field is generated between the narrower portions 104*a* and 106*a* of the plate members 104 and 106, which are spaced apart from and opposite to each other.

The actuating part 26 is actuated so as to rotate around the shaft 98, as the card 96 is actuated by the magnetic force generated by the electromagnet part 24. The rotational movement of the actuating part 26 around the shaft 98 is transmitted to movable contacts 108 and 110 of the contact part 28, which will be described below, via the card 96. The card 96 has upper protruding pieces 112*a* and 114*a* projecting toward the actuating body 94, which are spaced apart from each other and extend in parallel to each other. The card 96 also has two vertical pieces 112 and 114 which are spaced apart from each other and extend in parallel to each other, and extend downward and perpendicularly to the upper protruding pieces 112*a* and 114*a*. At a lower end of the vertical piece 112, there is a lower protruding piece 112*b* extending toward the actuating body 94 and perpendicularly to the vertical piece 112. The card 96 is fitted to the actuating body 94 by inserting the upper protruding pieces 112*a* and 114*a* and the lower protruding piece 112*b*, which are oriented toward the actuating body 94, to corresponding engaging holes 116, 118 and 120 of the actuating body 94. In this way, the actuating body 94 and the card 96 are integrated with each other, so as to move together. The two vertical pieces 112 and 114 of the card 96 have bulging portions 112*c* and 114*c*, respectively, which bulge toward each other. A part of a movable spring 122 of the contact part 28, which will be described below, is situated in a gap between the vertical pieces 112 and 114, so as to be sandwiched on both sides by the bulging portions 112*c* and 114*c*. As described above, since the movable spring 122 is held by the card 96, the movable spring 122 is also actuated in accordance with the movement of the actuating part 26.

The contact part 28 including the movable contacts 108 and 110 and the fixed contacts 124 and 126 will be described below. The contact part 28 includes a pair of bus bar terminals 20 and 22, a movable spring 122 attached to the bus bar terminal 20, and a flat braided wire 128 placed along the movable spring 122. The contact part 28 as illustrated is a twin contacts type which employs two pairs of contacts capable of opening and closing. The fixed contacts 124 and 126 are in the form of a rivet, and attached to the bus bar terminal 22 by fastening to an upper through-hole 130 and a lower through-hole 132 formed in the bus bar terminal 22. The bus bar terminal 22, as a whole, is positioned along the wall portion 40 in the recess 38 of the base 12. At the end (left side in FIG. 1) of the bus bar terminal 22, there is a flat end plate portion 22*a* which is pressed into and held in the groove 44 defined by the U-shaped tip 40*a* of the wall portion 40. Further, the bus bar terminal 22 has an intermediate engageable portion 22*b* which is engaged with a groove 36 formed on one edge of the peripheral wall 32 of the base 12, a flat end plate portion 22*c* extending from the engageable portion 22*b* in a direction opposite to the flat end plate portion 22*a* and projecting from the base 12, and a flat attachment plate portion 22*d* bent at the lower end of the flat end plate portion 22*c* substantially at right angle and extending substantially horizontally. The flat attachment plate portion 22*d* has at the center a through-hole 23, through which a known attaching means such as a bolt is fastened, whereby the electromagnetic relay 10 can be attached to any support body such as a substrate.

The movable contacts 108 and 110 also in the form of a rivet are fastened to an upper through-hole 134 and a lower through-hole 136 formed at one end of the movable spring 122 and to an upper through-hole 138 and a lower through-hole 140 of the flat braided wire 128, whereby the movable contacts 108 and 110 are attached to the movable spring 122 and the flat braided wire 128. The movable contacts 108 and 110 are situated opposite to the fixed contacts 124 and 126 described above. At the end opposite to the through-holes 134 and 136 of the movable spring 122, there are attaching holes 142 and 144. Similarly, there are attaching holes 146 and 148 at the end opposite to the through-holes 138 and 140 of the flat braided wire 128. Rivets 150 and 152 are fastened through these attaching holes 142, 144, 146 and 148 and attaching holes 154 and 156 formed in the flat end plate portion 20*a* of the bus bar terminal 20. The movable spring 122 and the flat braided wire 128 have a fixed end fixed to the bus bar terminal 20, and a free end provided with the movable contacts 108 and 110 at the other end, respectively. The movable spring 122 and the flat braided wire 128 are coupled to each other at both ends. In this way, the intermediate portion of the movable spring 122 is received between the vertical pieces 112 and 114 of the card 96 as described above, the intermediate portion of the flat braided wire 128 extends apart from the movable spring 122 and along the outsides (backsides in FIG. 1) of the actuating body 94 and the card 96 (see FIG. 2).

With the configuration in which the flat braided wire 128 having a large electric capacity is provided in parallel to the movable spring 122, it is possible to decrease electric resistance of the circuit of the movable contacts 108 and 110, while keeping the cross section area of the movable spring 122 small. Thus, such a configuration has an advantage to reduce heat generated at the contact part 28, especially when a large current flows through the electromagnetic relay 10. In addition, since the flat braided wire 128 having greater flexibility than a leaf spring is used as a bypass pathway, smaller force will be required to open and close the contact part 28.

Referring to FIG. 6, one example of the flat braided wire 128 used in the present embodiment will be described in more detail.

Figure 6A:
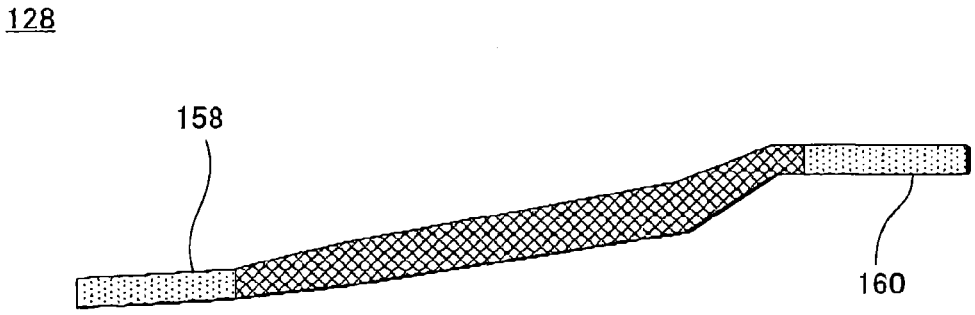
FIG. 6A is a side view illustrating a flat braided wire according to the first embodiment of the present invention.
Figure 6B:
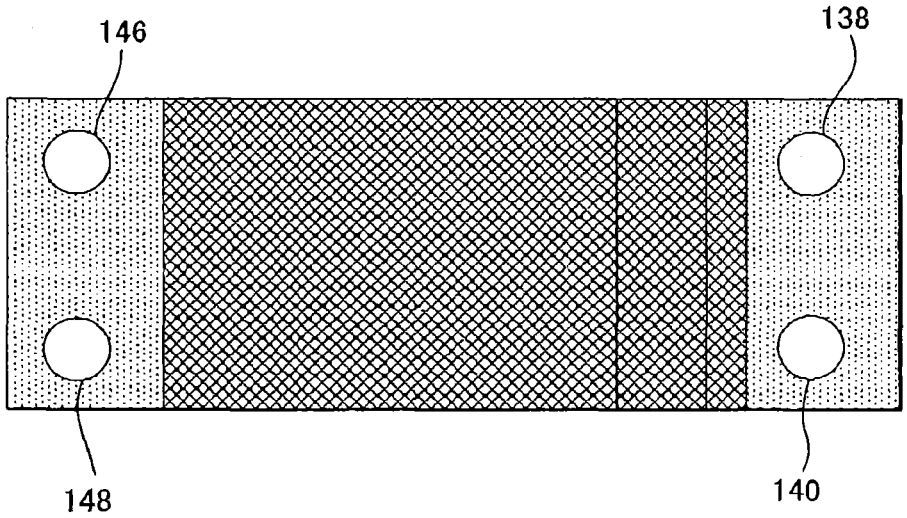
FIG. 6B is a plan view illustrating the flat braided wire according to the first embodiment of the present invention.

FIG. 6A is a side view illustrating the flat braided wire 128 only, and FIG. 6B is a plan view thereof. The flat braided wire 128 placed along the movable spring 122 is bent at several points spaced apart from one another in the longitudinal direction, since the flat braided wire 128 extends along the outside of the actuating body 94 to a position where it is attached to the movable contacts 108 and 110, as described above. At both ends of the flat braided wire 128, there are melted portions 158 and 160 which have been melted into a flat plate shape, as well as the through-holes 138 and 140 and the attaching holes 146 and 148. While a flat braided wire is normally made from conducting wires which have been braided and bundled together, the melted portions 158 and 160 are formed by heating and melting both ends of the flat braided wire into a substantially flat plate shape. Since the melted portions 158 and 160 having a flat plate shape is formed to the flat braided wire which has been provided as a single braided unit, there is no need to provide a separate flat plate member, such as a clamp member, to the flat braided wire. Further, at the melted portions 158 and 160, the through-holes 138 and 140 and attaching holes 146 and 148 are formed by pressing. Such a configuration reduces the number of parts and makes the flat braided wire 128 compact. In addition, since the intermediate portion between the melted portions 158 and 160 remains in the original form of a flat braided wire, the above-mentioned advantages resulting from the flat braided wire is maintained.

The bus bar terminal 20 has a flat end plate portion 20*a* having attaching holes 154 and 156, an intermediate engageable portion 20*b* which is engaged with the groove 34 formed on one edge of the peripheral wall 32 of the base 12, a flat end plate portion 20*c* extending from the engageable portion 20*b* in a direction opposite to the flat end plate portion 20*a* and projecting from the base 12, and a flat attachment plate portion 20*d* bent at the lower end of the flat end plate portion 20*c* substantially at right angle and extending substantially in the horizontal direction. The bus bar terminal 20 is fixed to the base 12 by pressing the engageable portion 20*b* into the groove 34 of the base 12. The flat attachment plate portion 20*d* has a through-hole 21 which receives a known fixing means such as a bolt, similarly to the flat attachment plate portion 22*d* of the bus bar terminal 22, whereby the bus bar terminal 20 can be mounted to any support body such as a substrate.

In the case where passage and blockage of a high voltage and/or a large current is switched through the electromagnetic relay 10, arc discharge may occur between the contacts, as the movable contacts 108 and 110 are moved apart from the fixed contacts 124 and 126 so as to block electricity between the bus bar terminals 20 and 22. The arc discharge may also occur, as the contacts apart from each other are moved closer so as to conduct electricity. In order to solve the problem, according to this embodiment, a permanent magnet 58 is provided at a position corresponding to the contact part 28, more specifically, in a position opposite to the movable contacts 108 and 110 and the fixed contacts 124 and 126. By positioning the permanent magnet 58 such that a magnetic flux of the permanent magnet 58 traverses a gap between the movable contacts 108 and 110 and the fixed contacts 124 and 126, the arc discharge between the contacts is extended toward the permanent magnet 58, and as a result, the arc discharge is cut off.

On the outer surface of the end wall 56 of the cover 14 opposite to the recess 38, there is an accommodating portion 60 which is depressed toward the contact part 28. By pressing and fixing the permanent magnet 58 into the accommodating portion 60 integrally formed in the cover 14, the permanent magnet 58 can be easily placed in position relative to the contact part 28. More specifically, the permanent magnet 58 extends over longer distance than a gap between the contacts formed as a result of movement of the movable contacts 108 and 110 to the right in FIG. 5 from a position at which the movable contacts 108 and 110 and the fixed contacts 124 and 126 are in contact with each other, as shown in FIG. 5. The permanent magnet 58 is also provided substantially in parallel to a straight line extending the shortest distance in the gap. In addition, the permanent magnet 58 is provided in the accommodating portion 60 such that the magnetizing direction of the permanent magnet 58 coincides with a depth direction of the accommodating portion 60. With the configuration, a magnetic field perpendicular to the moving direction of the movable contacts 108 and 110 is generated, and thus arc discharge can be cut off. The accommodating portion 60 is a recess with a bottom having a depth so as to extend from the outer surface of the end wall 56 to the vicinity of the contact part 28 (FIG. 5). In the illustrated embodiment, since the permanent magnet 58 is provided in the vicinity of the contact part 28 with a part of the cover 14 interposed therebetween, an effect of cutting off the arc discharge between the contacts can be achieved. In order to secure the permanent magnet 58 in the accommodating portion 60, sealing resin may be injected into the accommodating portion 60. In this case, it is preferable that the accommodating portion 60 is designed to have a depth sufficiently large so that the sealing resin does not stick out from the outer surface of the end wall 56. This facilitates various handling of the electromagnetic relay 10 such as transportation, storage or attachment to the substrate.

The permanent magnet 58 may also be positioned in the accommodating portion 60 in a different manner. For example, after the permanent magnet 58 is placed in the accommodating portion 60, the permanent magnet 58 may be fixed by an additional holding member (not shown) which can be pressed into the accommodating portion 60 so as to keep the permanent magnet 58 in position within the accommodating portion 60.

In other alternative embodiment, which is not illustrated, the permanent magnet 58 may be accommodated in a protrusion protruding from the outer surface of the end wall 56 of the cover 14. This configuration is effective when the internal space of the housing is severely restricted.

In the embodiment described above, the arc discharge does not directly reach the permanent magnet 58, since the end wall 56 of the cover 14 is interposed between the contact part 28 and the permanent magnet 58. In addition, with the interposed end wall 56, the permanent magnet 58 can be easily mounted without the effect of magnetic attractive force to metal components. Furthermore, in the embodiment in which the permanent magnet 58 is sealed by injecting resin into the accommodating portion 60, mechanical damages to the permanent magnet 58 can also be prevented.

The electromagnetic relay 10 according to the embodiment can be assembled in the following manner. First, each component of the electromagnet part 24, the actuating part 26 and the contact part 28 is mounted in position to the base 12 in a known way such as pressing and adhering (FIG. 2). The cover 14 is then placed and positioned at the opening end of the peripheral wall 32, and the joining portion 54 is engaged with the engageable portion 32*a*, closing the recess 38. The permanent magnet 58 is placed in the accommodating portion (recess) 60 of the cover 14. In this process, the permanent magnet 58 may be pressed into the accommodating portion 60 such that the permanent magnet 58 is temporarily fixed, so as to be prevented from being easily detached. The permanent magnet 58 may also be temporarily fixed by pressing a separate member against the permanent magnet 58. The permanent magnet 58 may be provided in the accommodating portion 60 prior to mounting the cover 14 to the base 12.

The permanent magnet 58 is then sealed by injecting resin from the top of the permanent magnet 58 situated in the accommodating portion 60. In this process, sealing resin is simultaneously injected between the joining portion 54 in the outer periphery of the cover 14 and the engageable portion 32*a* of the peripheral wall 32 of the base 12, and thus, a housing is formed by attaching the cover 14 to the base 12 in a sealing manner. Alternatively, one of the processes of attaching the cover 14 to the base 12 and sealing the permanent magnet 58 may also be carried out first, and the other process is carried out without delay in a continuous manner. In these ways, the attaching process between the base 12 and the joining portion 54 of the cover 14 and the sealing process of the permanent magnet 58 in relation to the end wall 56 are simultaneously or continuously carried out on the side of the cover 14 as a single sealing process. Therefore, a process necessary to move a nozzle for injecting resin or change position of the housing can be omitted, and a production procedure is simplified.

As such, according to the illustrated embodiment, passing and blocking a high voltage and/or a large current can be easily performed by an inexpensive electromagnetic relay.

Next, a second embodiment of the present invention will be described with reference to FIGS. 7 and 8. In the description on the following alternative embodiments, matters which have already been explained in relation to the first embodiment and commonly apply to the second embodiment will be omitted.

Figure 7:
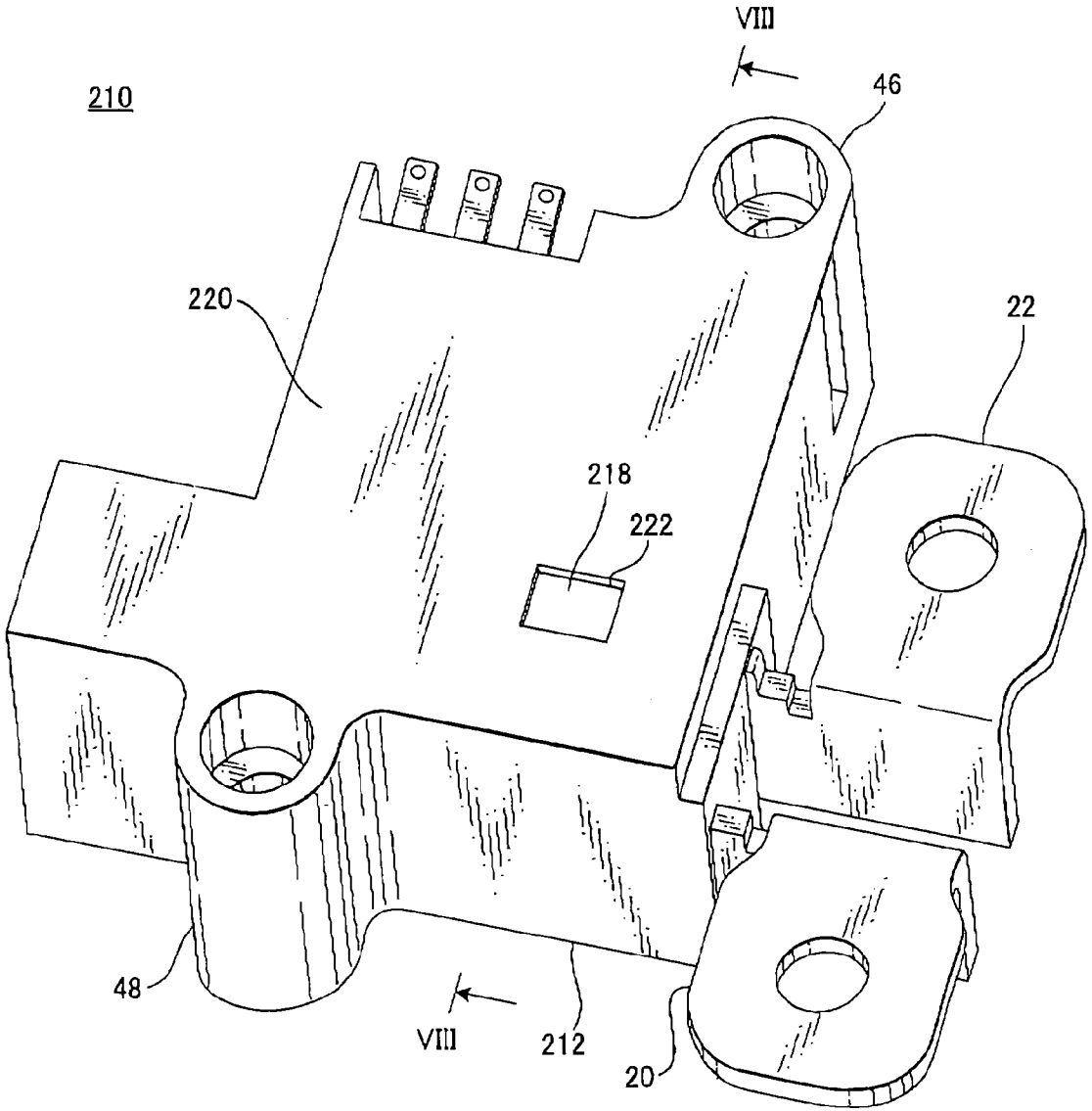
FIG. 7 is a perspective view illustrating an electromagnetic relay according to a second embodiment of the present invention, viewed from the base.
Figure 8:
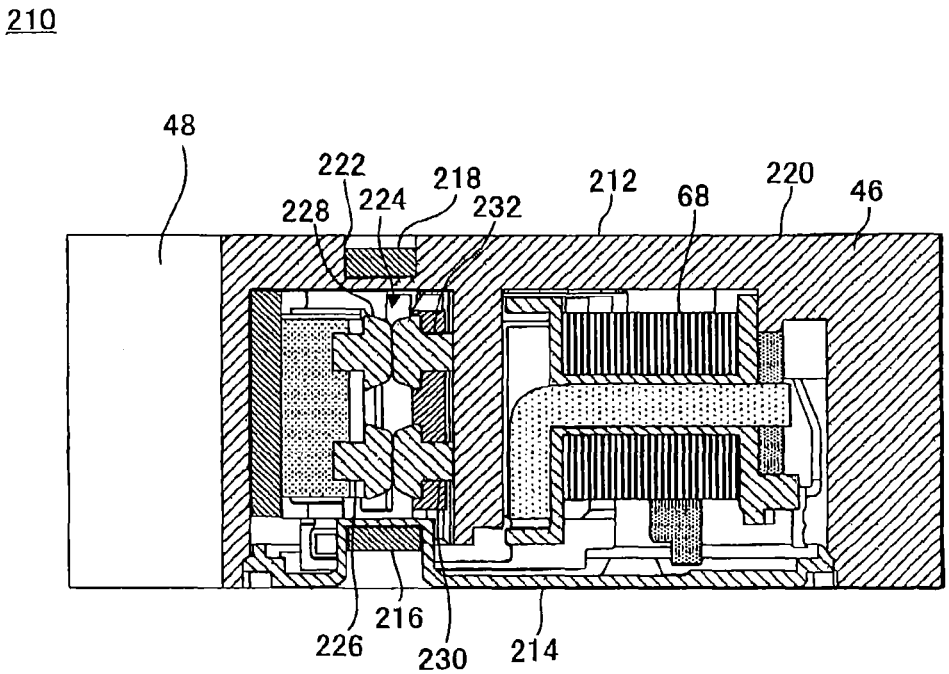
FIG. 8 is a sectional view illustrating the electromagnetic relay according to the second embodiment of the present invention, taken along line VIII-VIII in FIG. 7.

FIG. 7 is a perspective view illustrating an electromagnetic relay 210, viewed from the base 212. FIG. 8 is a sectional view taken along line VIII-VIII in FIG. 7. A perspective view of the electromagnetic relay 210 viewed from the cover 214 is omitted, since it is the same as FIG. 3.

In this embodiment, in addition to the permanent magnet 216 provided to the cover 214, a separate permanent magnet 218 is provided at a position corresponding to the contact part 28 on the outer surface of the end wall 220 of the base 212 opposite to the recess 38, so as to be opposite to the contact part 28. As more clearly seen in FIG. 8, on the outer surface of the end wall 220 of the base 212 opposite to the recess 38, an accommodating portion 222 depressed toward the contact part 224 is formed and the permanent magnet 218 is provided in the accommodating portion 222. The permanent magnets 216 and 218 extend over longer distance than a gap between the movable contacts 226 and 228 and the fixed contacts 230 and 232 formed as a result of movement of the movable contacts 226 and 228 and extend substantially in parallel to a straight line extending the shortest distance in the gap. The permanent magnet 218 may be pressed into the accommodating portion 222 or sealed into the accommodating portion 222 with resin. In the present embodiment, thickness of the end wall 220 of the base 212 is greater than that of the first embodiment. This prevents the accommodating portion 222 from projecting from the outer surface of the end wall 220, even in the case where the permanent magnet 218 is accommodated in the base 212. Therefore, various handling of the electromagnetic relay 10 such as transportation, storage or attachment to the substrate is facilitated.

In the present embodiment, since the permanent magnets 216 and 218 are provided on both sides of the contact part 224, a greater magnetic flux perpendicular to the contact part 224 is generated. As a result, a greater effect of cutting off the arc discharge is achieved, compared with the case where the permanent magnet 216 is provided only on the cover 214.

Figure 9:
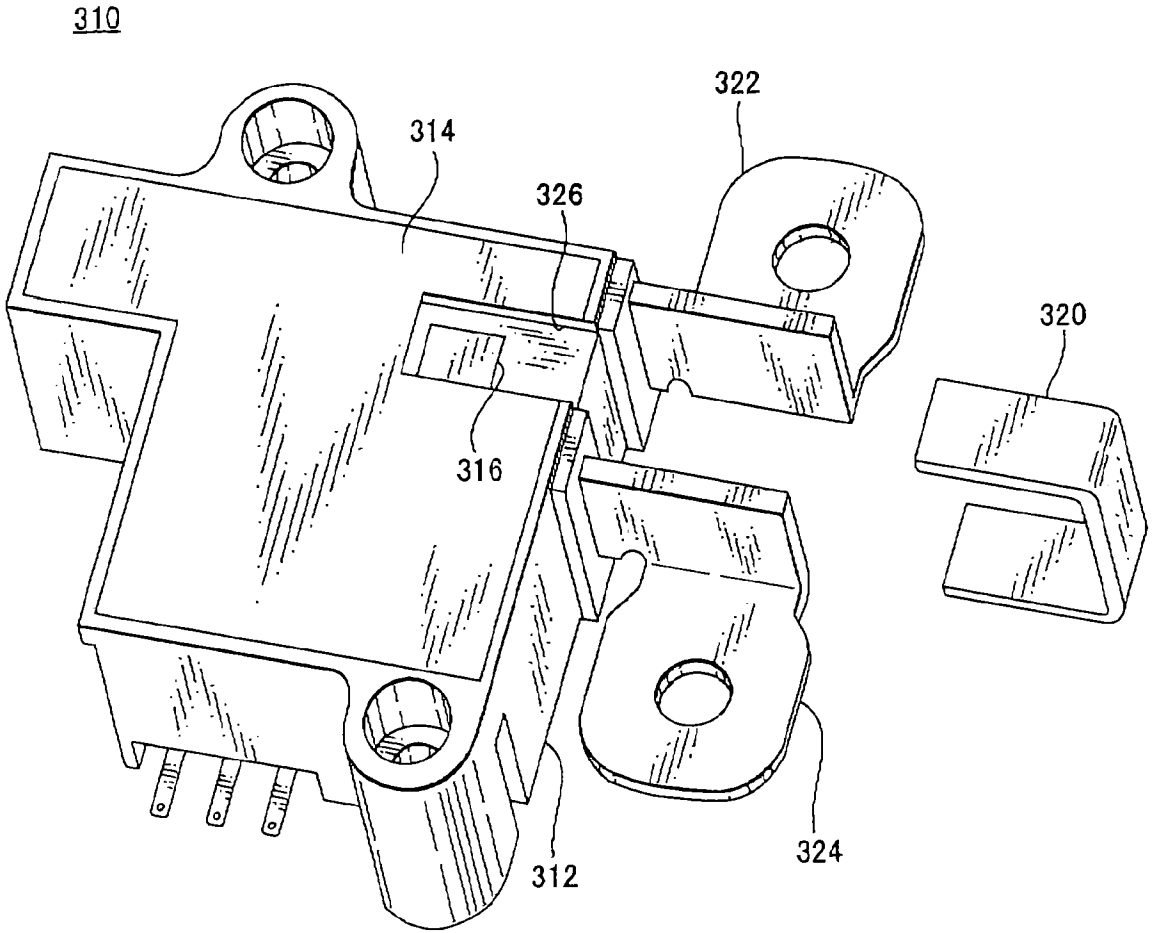
FIG. 9 is a partial exploded view illustrating an electromagnetic relay according to a third embodiment of the present invention in a state before a yoke is attached thereto.
Figure 10:
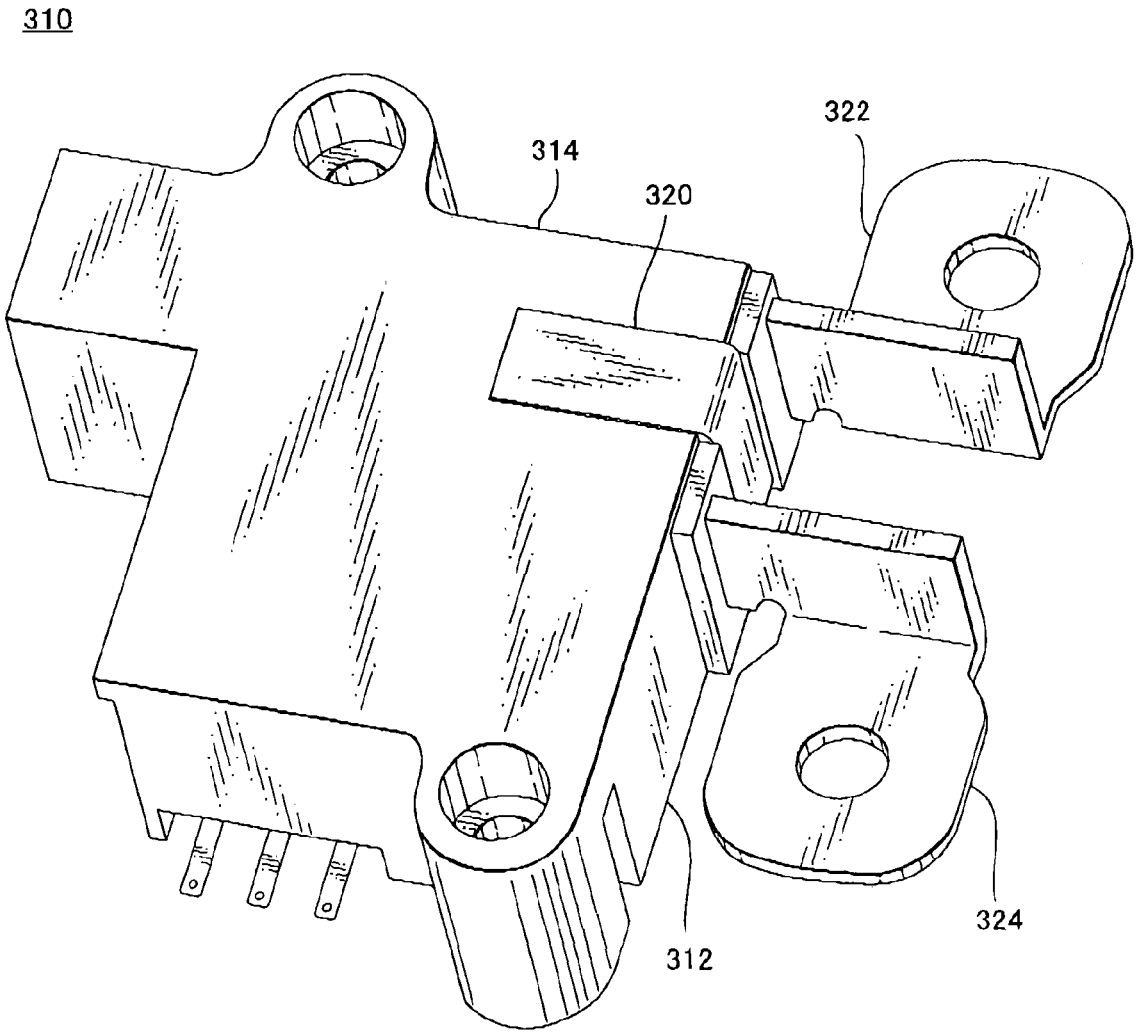
FIG. 10 is a perspective view illustrating the electromagnetic relay according to the third embodiment of the present invention, viewed from the cover.
Figure 11:
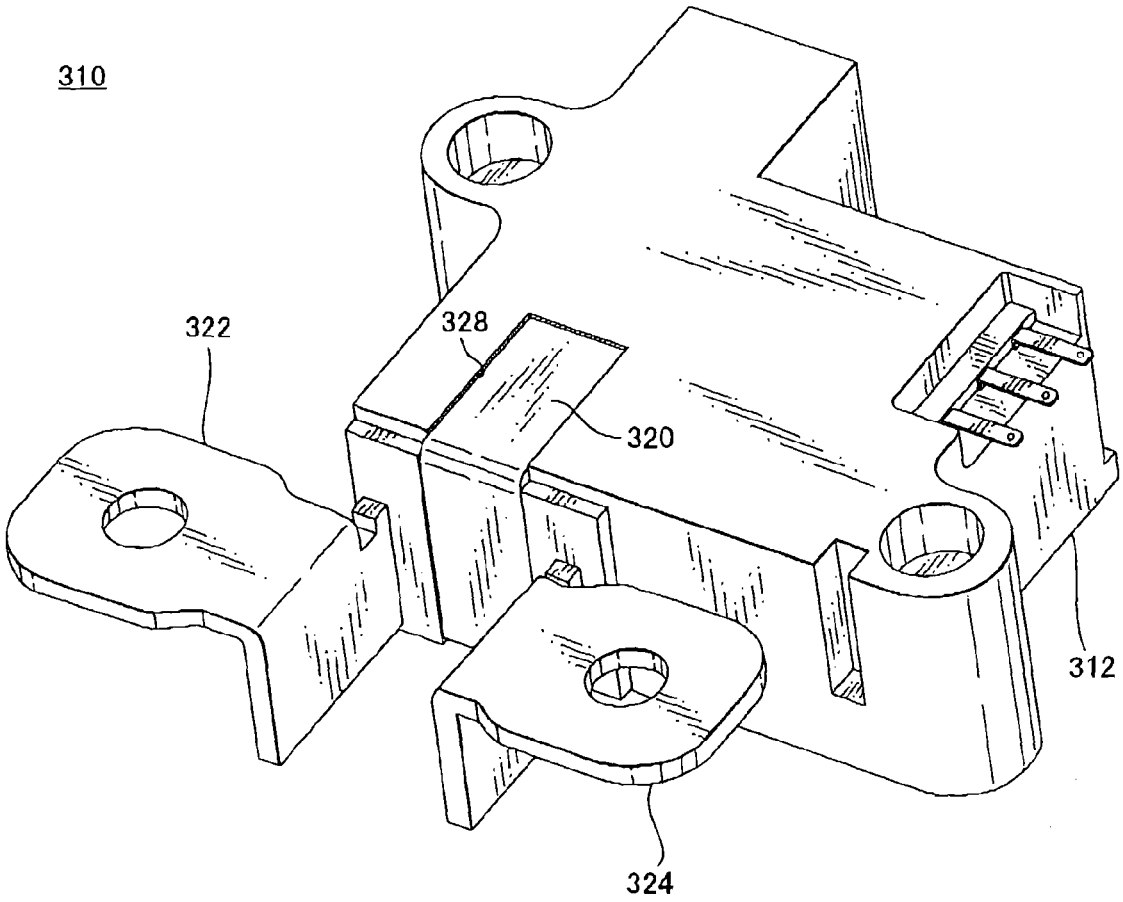
FIG. 11 is a perspective view illustrating the electromagnetic relay according to the third embodiment of the present invention, viewed from the base.
Figure 12:
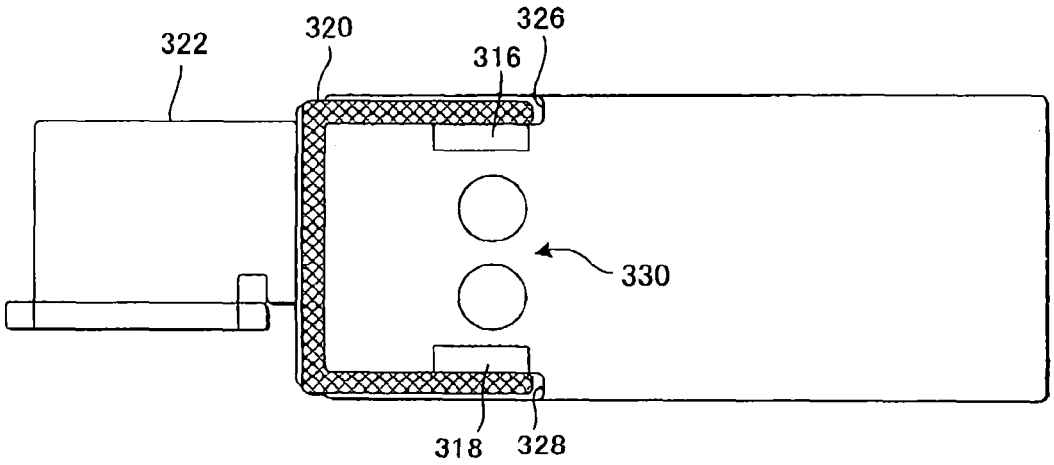
FIG. 12 is a sectional view schematically illustrating the electromagnetic relay according to the third embodiment of the present invention.

Referring to FIGS. 9 to 12, a third embodiment of the present invention will be described. FIG. 9 is a partial exploded view of an electromagnetic relay 310, FIG. 10 is a perspective view illustrating the electromagnetic relay 310, viewed from the cover 314, FIG. 11 is a perspective view illustrating the electromagnetic relay 310, viewed from the base 312, and FIG. 12 is a sectional view schematically illustrating relationship between positions of permanent magnets 316 and 316 and a yoke 320. In FIG. 12, components which are not referred to in the explanation of the embodiment are omitted for the sake of clarity.

In the present embodiment, permanent magnets 316 and 318 are provided on both of the cover 314 and the base 312. Further, a yoke 320 is mounted to the outer side of the cover 314 and the base 312. The yoke 320 is fitted to the housing between a pair of the bus bar terminals 322 and 324, so as to extend between pathways of an electric current passing through the bus bar terminals 322 and 324, which serve as terminals to the exterior and are switched between a conducting state and a non-conducting state by means of the electromagnetic relay 310. In the present embodiment, in order to provide insulating distance as well as a space large enough to place the yoke 320 therein, longer distance between the bus bar terminals 322 and 324 is formed, compared with other embodiments. As most clearly seen in FIG. 12, the yoke 320 has a U-shaped cross section extending along the outer side of the housing, so as to be connected to the permanent magnet 316 provided on the cover 314 and to the permanent magnet 318 provided on the base 312. The base 312 and the cover 314 have grooves 326 and 328 for receiving the yoke 320, and the yoke 320 is attached along the grooves 326 and 328. The yoke 320 may be mounted to the grooves 326 and 328 by pressing or in other known manners. In the illustrated embodiment, the grooves 326 and 328 are formed so as to receive the yoke 320 entirely. However, a groove may also be formed only one of the end walls of the base 312 and the cover 314. The grooves 326 and 328 have a depth larger than thickness of the yoke 320, respectively, so that the yoke 320 does not project from the outer surface of the base 312 and the cover 314 when the yoke 320 is mounted. With the configuration, various handling of the electromagnetic relay 310 such as transportation, storage or attachment to the substrate is facilitated. Although not illustrated, as the distance between the bus bar terminals 322 and 324 widens, the shapes of a movable spring and a flat braided wire of the contact part 330 are modified so as to open and close the contacts in a similar manner to the other embodiments.

With the configuration according to the present embodiment, by means of the yoke 320, a magnetic path is formed between the permanent magnets 316 and 318, which are spaced apart from each other, and a magnetic flux generated by the permanent magnets 316 and 318 is transmitted through the yoke 320. Since magnetic force exerting on the contact part 330 becomes even greater, compared with the case where only the permanent magnets 316 and 318 are provided on the cover 314 and the base 312, a greater effect of cutting off the arc discharge is achieved. In addition, the yoke 320 is provided between the bus bar terminals 322 and 324 and in parallel thereto, an electric current flowing through the bus bar terminals 322 and 324 is not influenced by the yoke 320, or vice versa.

As a variant of the third embodiment, the permanent magnet 318 on the base 312 may be omitted. In this variant, the permanent magnet 316 is provided on the cover 314, and a yoke 320 having a U-shaped cross section extends from the permanent magnet 316 to the base 312 along the outer side of the housing. In the variant, a magnetic path extends from the permanent magnet 316 to a position opposite to the permanent magnet 316, and therefore, it is conceivable that an effect of cutting off the arc discharge is substantially equivalent to the configuration in which the permanent magnets 216 and 218 are provided opposite to the contact part 224, respectively, in accordance with the second embodiment.

The above embodiments are described, referring to exemplary twin contacts types of the electromagnetic relays with two contacts. However, according to the embodiments that achieve an effect of cutting off the arc discharge, a single contact type of electromagnetic relay with one contact may be also used for passing and blocking a high voltage and/or a large current. By changing to the single contact type, it is possible to reduce an amount of expensive material containing silver used for a contact, and therefore an inexpensive electromagnetic relay can be provided.

Although it is described that the permanent magnet for cutting off the arc discharge generates a magnetic field perpendicular to the arc discharge, the perpendicularity is not always strictly required. Thus, a magnetizing direction of the permanent magnet may be at an angle other than right angle in relation to the arc discharge, as long as the effect of cutting off the arc discharge is sufficiently achieved.

The numbers, shapes and arrangements of the attachment portions 46 and 48 are not limited to the illustrated embodiments. The shapes of the receiving portions 46*a*, 48*a*, 46*b* and 48*b* may also be modified, corresponding to various known attaching means, as necessary.

The invention claimed is:

1. An electromagnetic relay comprising:

an electromagnet that generates a magnetic field when electric current is supplied thereto;

an actuator that is actuated in response to the generated magnetic field;

a contact that opens and closes in response to the actuation of the actuator, the contact including a first contact and a second contact that contacts with the first contact when the contact closes;

a first external terminal connected to the first contact and a second external terminal connected to the second contact through which electric current flows to and out of the electromagnetic relay;

a housing that accommodates the electromagnet, the actuator, and the contact therein, the housing having surfaces including first and second outer surfaces;

a permanent magnet provided on the first outer surface of the housing at a position corresponding to a position of the contact; and a yoke, in which one end is connected to the permanent magnet and the other end extends toward the second outer surface of the housing opposite to the first outer surface, provided on and extending along the outer surfaces of the housing, the yoke passing through a space between the first external terminal and the second external terminal, wherein the yoke extends along a third outer surface of the housing extending between the first outer surface and the second outer surface, the first external terminal and the second external terminal extending out through the third outer surface.

2. The electromagnetic relay according to claim 1, further comprising:

a second permanent magnet provided on the second outer surface, at a position corresponding to the position of the contact, wherein the other end of the yoke is connected to the second permanent magnet.

3. The electromagnetic relay according to claim 1, wherein the housing has, on the first outer surface, an accommodating portion which is depressed toward the contact part, the permanent magnet being situated in the accommodating portion.

4. The electromagnetic relay according to claim 2, wherein the housing has, on the second outer surface, a second accommodating portion which is depressed toward the contact part, the second permanent magnet being situated in the second accommodating portion.

5. The electromagnetic relay according to claim 1, wherein the housing has a groove for receiving the yoke.

6. The electromagnetic relay according to claim 1, wherein the contact further comprises:

a fixed spring on which the first contact is provided;

a movable spring on which the second contact is provided, the movable spring being actuated by the actuator; and a flat conductive portion, one end of which is electrically connected to one end of the movable spring, and the other end of which is electrically connected to the other end of the movable spring.

7. The electromagnetic relay according to claim 6, wherein the flat conductive portion is made of a flexible material.

8. The electromagnetic relay according to claim 6, wherein the flat conductive portion is a flat braided wire.

9. An electromagnetic relay comprising:

an electromagnet that generates a magnetic field when electric current is supplied thereto;

an actuator that is actuated in response to the generated magnetic field;

a contact that opens and closes in response to the actuation of the actuator, the contact including a first contact and a second contact that contacts with the first contact when the contact closes;

a pair of external terminals through which electric current flows to and out of the electromagnetic relay;

a housing that accommodates the electromagnet, the actuator and the contact therein;

a permanent magnet provided on an outer surface of the housing at a position corresponding to a position of the contact;

a yoke in which one end is connected to the permanent magnet and the other end extends toward an outer surface of the housing opposite to the outer surface on which the permanent magnet is provided, along an outer side of the housing and between the pair of the external terminals;

a fixed spring on which the first contact is provided;

a movable spring on which the second contact is provided, the movable spring being actuated by the actuator; and a flat conductive portion, one end of which is electrically connected to one end of the movable spring, and the other end of which is electrically connected to the other end of the movable spring.

10. The electromagnetic relay according to claim 9, wherein the flat conductive portion is made of a flexible material.

11. The electromagnetic relay according to claim 9, wherein the flat conductive portion is a flat braided wire.

12. An electromagnetic relay comprising:

an electromagnet that generates a magnetic field when electric current is supplied thereto;

an actuator that is actuated in response to the generated magnetic field;

a contact that opens and closes in response to the actuation of the actuator, the contact including a first contact and a second contact that contacts with the first contact when the contact closes, the contact including a fixed spring on which the first contact is provided, a movable spring on which the second contact is provided and being actuated by the actuator, and a flat conductive portion, one end of which is electrically connected to one end of the movable spring, and the other end of which is electrically connected to the other end of the movable spring;

a first external terminal connected to the first contact and a second external terminal connected to the second contact through which electric current flows to and out of the electromagnetic relay;

a housing that accommodates the electromagnet, the actuator, and the contact therein;

a permanent magnet provided on a first outer surface of the housing at a position corresponding to a position of the contact; and a yoke, in which one end is connected to the permanent magnet and the other end extends toward a second outer surface of the housing opposite to the first outer surface, along an outer side of the housing and between the first and second external terminals.

* * * * *